United States Patent [19]

Okamoto et al.

[11] Patent Number: 4,466,324

[45] Date of Patent: Aug. 21, 1984

[54] AUTOMATIC PERFORMING APPARATUS OF ELECTRONIC MUSICAL INSTRUMENT

[75] Inventors: Eisaku Okamoto, Hamakita; Kotaro Mizuno, Hamamatsu, both of Japan

[73] Assignee: Nippon Gakki Seizo Kabushiki Kaisha, Hamamatsu, Japan

[21] Appl. No.: 324,599

[22] Filed: Nov. 24, 1981

[30] Foreign Application Priority Data

Dec. 4, 1980 [JP] Japan ..... 55-171314

[51] Int. Cl.[3] ..... G10F 1/00

[52] U.S. Cl. ..... 84/1.03; 84/1.19; 84/1.24; 84/470 R

[58] Field of Search ..... 84/1.03, 1.19, 470 R, 84/1.01, 1.24

[56] References Cited

U.S. PATENT DOCUMENTS 4,355,559 10/1982 Uya et al. ..... 84/1.03

4,358,980 11/1982 Imamura ..... 84/1.19

4,378,720 4/1983 Nakada et al. ..... 84/470 R

*Primary Examiner*—Forester W. Isen

*Attorney, Agent, or Firm*—Oblon, Fisher, Spivak, McClelland & Maier

[57] ABSTRACT

An automatic performing apparatus of an electronic musical instrument arranged to produce musical tones is response to musical performance data read out of an external storage such as a musical sheet. The external storage stores the musical performance data and control data to control generation mode of musical tone signals to be produced. In the apparatus, musical performance data and control data are stored in separate memories. In order for a player to change the generation mode of musical tone signals intentionally, a plurality of panel switches are associated with a control data memory so that the control data for tone generation mode can be rewritten by operation of any one of panel switches.

7 Claims, 10 Drawing Figures

FIG. 2
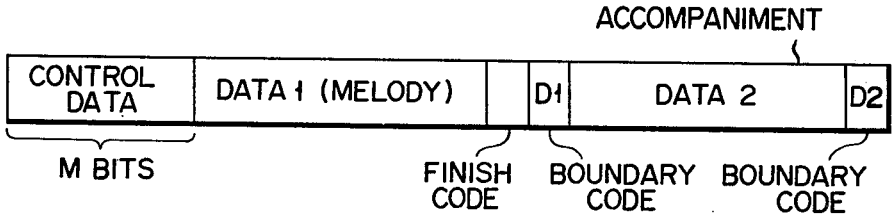
FIG. 3A
| 6 BITS | 6 BITS |
|---|---|
| PITCH | DURATION |
| PITCH | DURATION |
| PITCH | DURATION |
| | |
| | |
| PITCH | DURATION |
| PITCH | DURATION |
| FINISH | |
FIG. 3B
| | |
|---|---|
| ROOT NOTE | DURATION |
| ROOT NOTE | DURATION |
| ROOT NOTE | DURATION |
| | |
| | |
| ROOT NOTE | DURATION |
| ROOT NOTE | DURATION |
FIG. 4
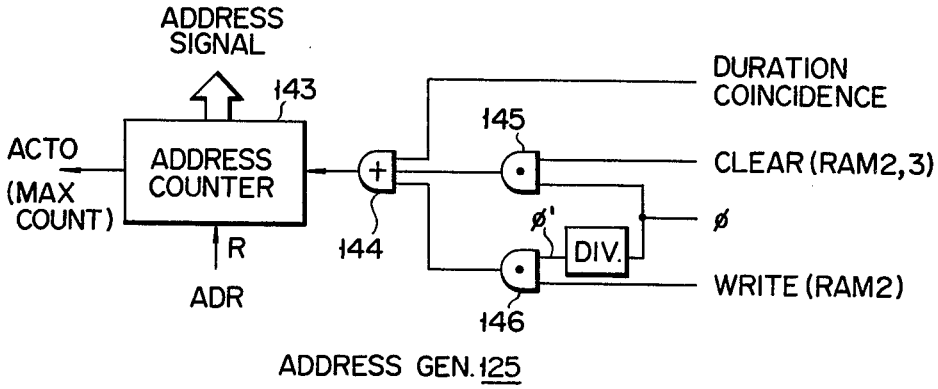

AUTOMATIC PERFORMING APPARATUS OF ELECTRONIC MUSICAL INSTRUMENT

BACKGROUND OF THE INVENTION

The present invention relates to an automatic performing apparatus of an electronic musical instrument which reads out performance information stored on an appropriate recording medium and generates tone signals according to the performance information.

An automatic performing apparatus of this type is provided with a memory to store performance information read out of the recording medium. The memory successively stores musical note data including pitch data and duration data with progression of a melody. And note data are successively read out of the memory at time intervals corresponding to note durations, and musical tone signals having pitches corresponding to the pitch data read out are formed. Such an automatic performing apparatus may be provided with an auto rhythm playing device, and the note duration is measured by a tempo clock signal used for rhythm generation. An example of such apparatus is disclosed in our copending U.S. patent application Ser. No. 217,896 filed on Dec. 18, 1980, now U.S. Pat. No. 4,364,299, and assigned to the same assignee as the present application. Such a prior automatic performing apparatus is designed only for automatically generating a musical note signal corresponding to each melody note. It is desirable, however, that tone colors of generated tone signals and/or modulation effects such as vibrato or tremolo, that is, generation modes of tone signals, can be set automatically and also intentionally by a player. It is also desirable that rhythm patterns, start control, tempo control in an automatic rhythm performance be selected automatically and manually.

A performance by the automatic performing apparatus is naturally used as an exemplary one for a novice player. Therefore, from this aspect too, the generation mode of the automatically performed musical tones is desirable to be adjusted manually so that variations of the generation mode of musical tones can be acknowledged by the novice player.

SUMMARY OF THE INVENTION

An object of the invention is to provide an automatic performing apparatus of an electronic musical instrument in which a generation mode of musical tones of the automatic performance is automatically set and can be changed by a player of the instrument during an automatic performance.

An automatic performing apparatus according to the present invention is provided with a memory means for storing musical performance data comprising musical note data and control data for controlling generation modes of musical tones which are recorded on a recording medium and read out thereof. In response to the musical note data read out of the memory means, a melody tone forming means generates a musical tone signal and a generation mode of the musical tone signal is controlled by the control data. The musical note data and control data are stored in separate memories for an automatic performance. The musical tone forming means generates musical tone signals in response to the musical note data successively read out of a musical note data memory and the generating mode of the musical tone signal being generated depends on the control data of a control data memory. The control data memory is arranged so that the control data can be rewritten by means of panel switches.

BRIEF DESCRIPTION OF THE DRAWINGS

FIG. 2 is a data format of the performance information;

FIGS. 3A and 3B show a data format of the melody data and a format of the accompaniment data;

FIG. 4 shows a circuit diagram of an address generating circuit shown in FIG. 1;

DETAILED DESCRIPTION OF THE PREFERRED EMBODIMENT

Figure 1:
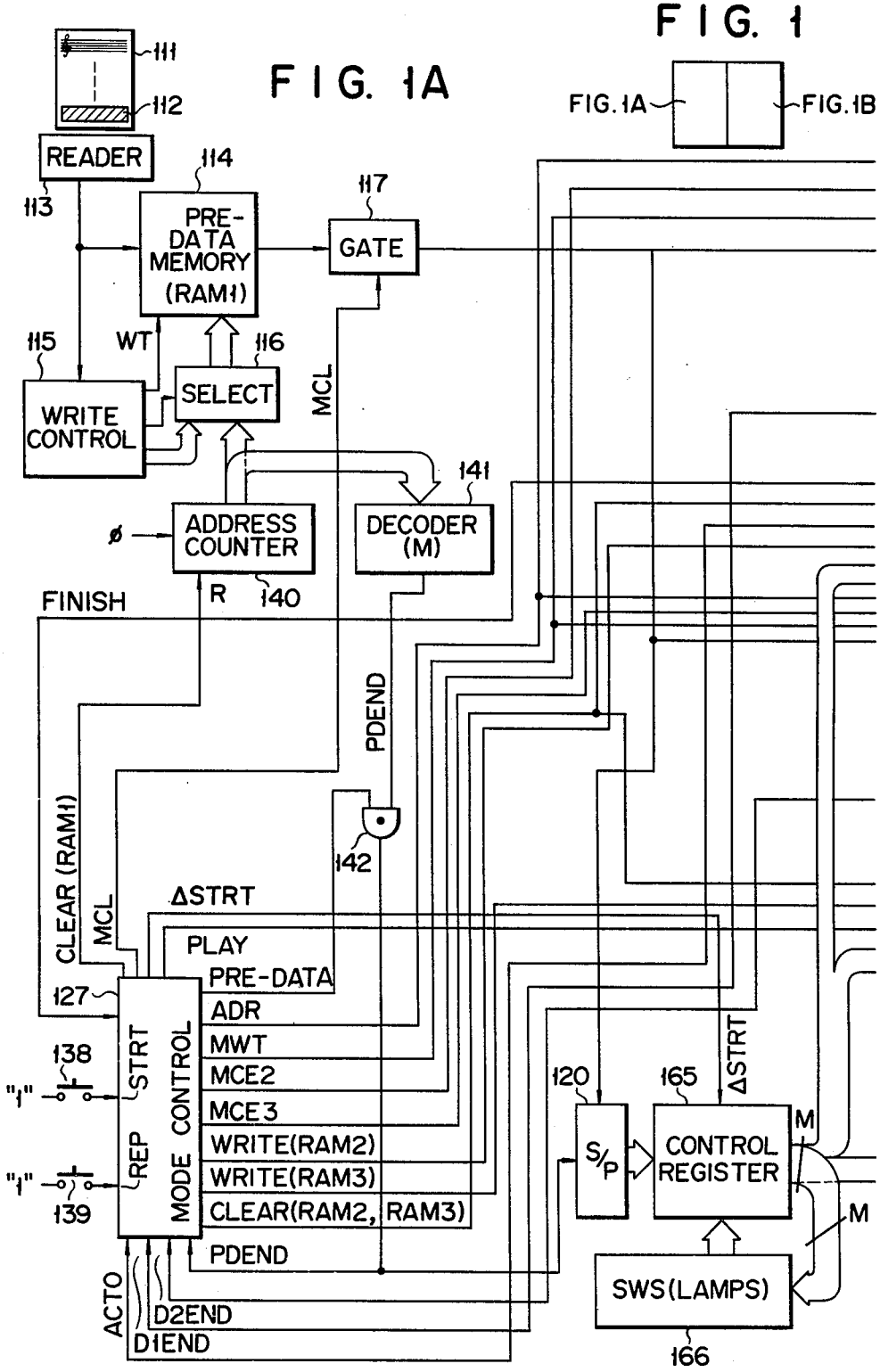
FIGS. 1A and 1B, taken together as in FIG. 1, show an embodiment of an automatic performing apparatus according to the present invention.
Figure 1B:
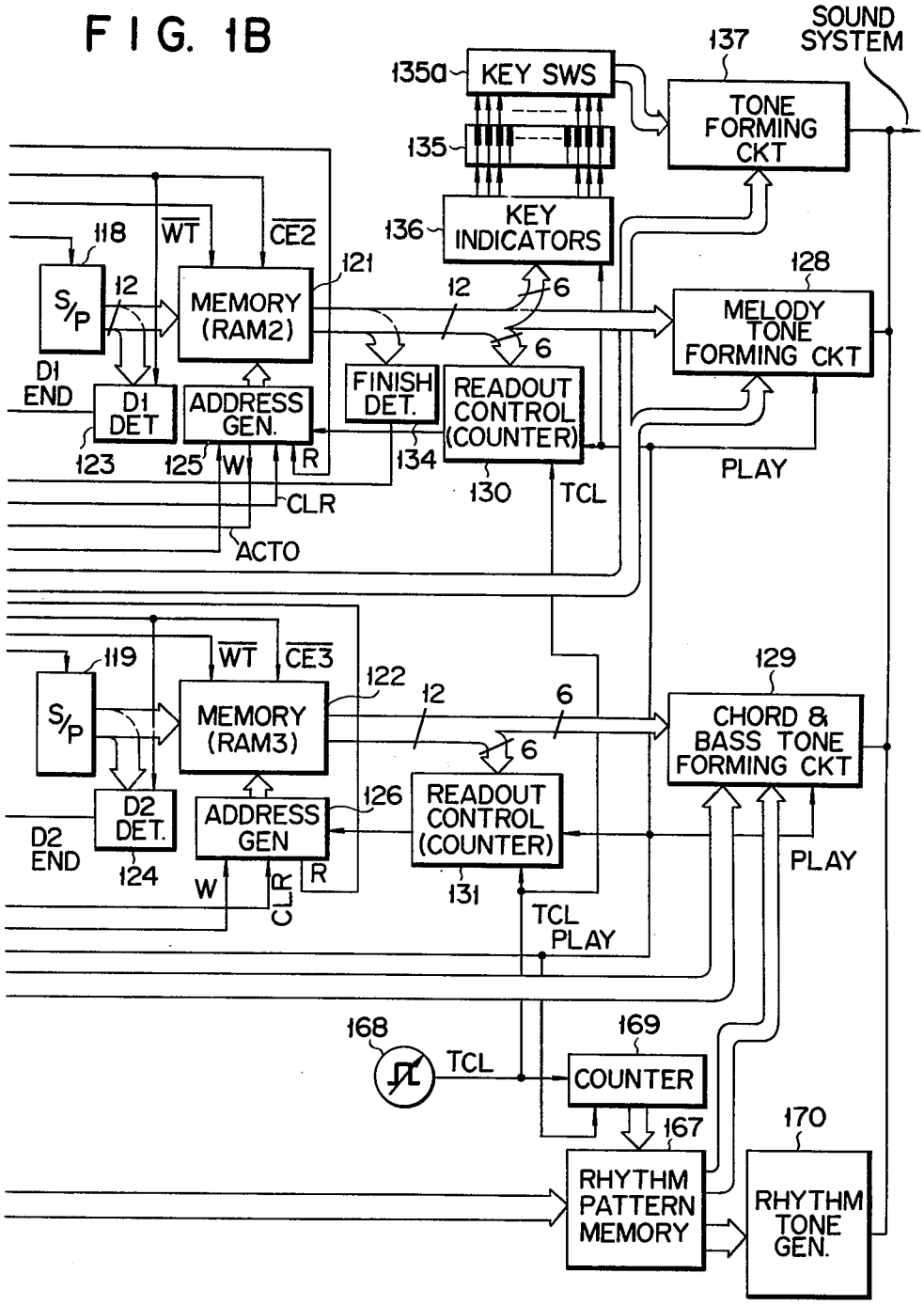

FIGS. 1A and 1B, taken together as in FIG. 1, show an embodiment of an automatic performing apparatus according to the present invention, in which an external memory device is constructed of a musical sheet 111 provided with a recording medium 112, such as a magnetic tape, located at the lower portion of the sheel 111. However, the external memory device may be such other external memory means as a bar-coded printing which is made on an appropriate sheet and a memory module which is detachably attached to the electronic musical instrument. Performance information is recorded on the recording medium 112 in a digital form. The musical sheet 111 is put in a usual way on a music stand of an electronic musical instrument. The music stand is provided with a reader 113 for reading the performance information out of the magnetic tape. The reader 113 further has a slit allowing the musical sheet 111 to be inserted thereinto. The musical sheet is moved along the slit by hand so that performance information is read out by a magnetic head of the reader. The digital performance information may be recorded on the magnetic tape in the form of clock pulses of a given frequency being phase-encoded with the performance information.

The performance information is recorded on the recording medium 112 in a format as shown in FIG. 2, for example. As shown, the performance information is made up of tone control data, melody performance data DATA 1 and accompaniment data DATA 2 which are arranged side by side on the magnetic tape 112. The control data is made up of M words each of one bit. The melody performance data DATA 1 includes note data arranged in the order of progression and each having a pitch data word of 6 bits and a duration data word of 6 bits, and is followed by a FINISH code, as shown in FIG. 3A. The FINISH code is further followed by the accompaniment data DATA 2, through a first boundary code D1. The accompaniment data DATA 2 includes 6-bit words representing the root note of a chord to be played together with the melody tones and 6-bit words representing duration of the chord, as shown in FIG. 3B. The accompaniment data DATA 2 is followed by a second boundary code D2.

The performance information read out by the reader 113 is loaded into a pre-data memory 114 such as RAM.

When the musical sheet 111 is loaded into the reader 113, a write control circuit 115 is instructed to apply a write instruction signal WT to the pre-data memory 114. Simultaneously, the write control circuit 115 counts clock pulses recorded together with the performance information to produce an address signal which is then applied through a selector 116 to the memory 114. At this time the selector 116 is instructed by the write control circuit 115 to select the address signal produced by the write control circuit 115. Then, the performance data recorded on the musical sheet 111 is read out by the reader 113 and written into the pre-data memory 114 in the format as shown in FIG. 2. The read operation terminates upon detection of the boundary code D2 following the second data DATA 2. The words stored in the memory 114 are each one bit.

The data stored in the memory 114 are serially read out and applied through a gate circuit 117 to first to third serial-to-parallel (S/P) converters 118, 119, and 120. As will be evident later, the first S/P converter 118 is adapted for conversion of the melody data DATA 1, and the second S/P converter 119 for the accompaniment data DATA 2. The third converter circuit 120 is adapted for the tone control data.

The parallel data from the first and second S/P converter circuits 118 and 119 are respectively applied to data memories 121 and 122, and also to boundary code detecting circuits 123 and 124 where the boundary code D1 following the first data DATA 1 and the boundary code D2 following the second data DATA 2 are detected. The memories 121 and 122 have their addresses respectively designated by the address generating circuits 125 and 126 and are set into write enable state or read enable state by a mode control circuit 127 supplied with boundary code detect signals D1 END and D2 END. The first data (melody part) read out of the pre-data memory 114 is loaded into the memory 121 and the second data (accompaniment part) is loaded into the memory 122.

The note data consisting of the pitch data and the duration data as shown in FIG. 3A are stored in the respective memory locations of the memory 121. In this case, rests are also stored as one of the pitch data (all "0"s), in combination with the duration data. And a finish code (FINISH) is stored to represent the end of the music. With progression of the melody, those note data are sequentially read out of the memory. Likewise, the pitch data and duration data for the root notes are stored in the memory locations of the memory 122, as shown in FIG. 3B.

The pitch data read out of the memories 121 and 122 are respectively supplied to an automatic melody tone forming circuit 128 and an automatic accompaniment tone forming circuit 129, and the duration data are supplied to readout control circuits 130 and 131. The melody tone forming circuit 128 produces a musical tone signal having a pitch corresponding to the pitch data applied thereto. The chord and bass tone forming circuit 129 generates chord tones containing a designated root note and a bass tone signal. Those generated tone signals are supplied to a sound system to be sounded.

In the readout control circuits 130 and 131, time corresponding to the duration data is counted to produce a duration coincidence signal after the lapse of the duration time from an instant of application of the duration data thereto. Duration coincidence signals produced by the readout control circuits 130 and 131 are applied to the address generating circuits 125 and 126, respectively. The output data of the memory 121 is monitored by a finish detecting circuit 134 which supplies a detect signal to a mode control circuit 127 when a finish code (FINISH) is read out. The pitch data read out of the memory 121 is supplied to a key indicator 136 for selectively indicating specified keys on the keyboard 135. Upon receipt of the pitch data, the key indicator 136 indicates a key to be depressed to assist player to play the keyboard. A key switch circuit **135*a* corresponding to the keyboard 135 produces keying signals representing the keys depressed which in turn enter the tone forming circuit 137** to produce tone signals corresponding to the depressed keys.

To the mode control circuit 127 are coupled a start switch 138 and a repeat switch 139 which issue, when depressed, a start instruction signal (STRT) and a repeat instruction signal (REP), respectively. The mode control circuit 127 controls the operation mode of the automatic performing apparatus. The pre-data memory 114, and the note data memories 121 and 122 will be referred hereinafter to as RAM 1, RAM 2 and RAM 3, respectively, for explanation of signals.

The mode control circuit 127 produces an RAM 1 address counter clear signal CLEAR (RAM 1) to reset the address counter 140 for the pre-data memory 114. The address counter 140 counts the clock $\phi$ so that a count signal thereof is applied as an address signal to the pre-data memory 114 through the selector 116. The count signal of the address counter 140 is also supplied to the decoder 141 for detecting the number M of bits of the control data. When the Mth address signal is generated, the decoder 141 produces a detect signal PDEND which in turn is supplied through AND circuit 142 to the mode control circuit 127. A pre-data instruction signal PRE-DATA derived from the mode control circuit 127 is applied as a gate signal to the AND circuit 142.

The mode control circuit 127 produces an address reset signal ADR to reset the address generating circuit 125 and issues a write instruction MWT to apply a write instruction signal $\overline{WT}$ to the memories 121 and 122. The mode control circuit 127 further produces chip enable instructions MCE 2 and MCE 3 corresponding to the memories 121 and 122 to apply chip enable signals $\overline{CE2}$ and $\overline{CE3}$. Together with the chip enable signals $\overline{CE2}$ and $\overline{CE3}$, the control circuit 127 issues write instructions WRITE (RAM 2) and WRITE (RAM 3) for the RAM 2 and RAM 3 to apply a data write signal to the address generating circuits 125 and 126. The mode control circuit further generates a clear signal CLEAR (RAM 2 and RAM 3) to clear the address generating circuits 125 and 126.

FIG. 4 shows an address generating circuit 125 which comprises an address counter 143. In the address counter 143, a maximum count value corresponding to the maximum address of the corresponding memory 121 is set. When the maximum count value (MAX count) is reached, the address counter 143 produces a signal ACTO which is applied to the mode control circuit 127. The count signal produced by address counter 143 is used as an address signal of the memory 121. The counter 143 is reset by the signal ADR and counted by an output signal of OR circuit 144 to which a duration coincidence signal of the readout control circuit 30 and output signals of AND circuits 145 and 146 are applied. The signals CLEAR (RAM 2 and RAM 3) and WRITE (RAM 2) are supplied as gate signals to the AND circuits 145 and 146 from which the clock signal $\phi$ or the frequency-divided clock $\phi'$ is derived. Namely, when receiving the clear or write signal, the address counter 143 is counted by the clock $\phi$ or the frequency-divided clock $\phi'$. Through this operation, the bits of "0" are loaded into the RAM 2 at the time of generation of the clear signal, to effectively clear the RAM 2. At the time of the generation of the write signal, parallel bits from the S/P converter 118 are loaded into the RAM 2 by the frequency-divided clock $\phi'$. The clock signal $\phi$ is frequency-divided by a factor corresponding to the number of bits of the S/P converter 118.

The address generating circuit 126 is constructed like the address generating circuit 125 but comprises no output circuit for producing the signal ACTO.

Figure 5:
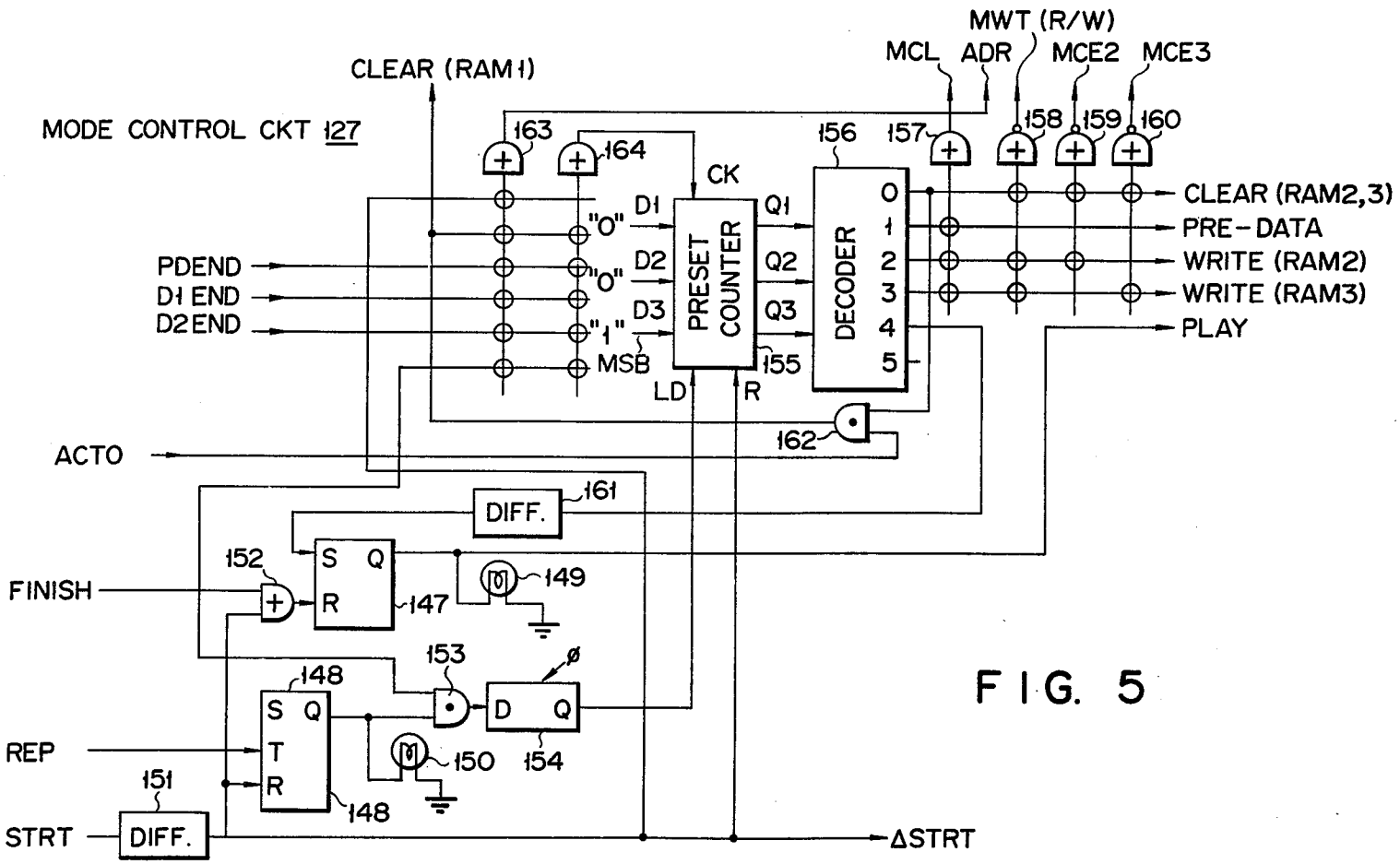
FIG. 5 shows a circuit diagram of a mode control circuit shown in FIG. 1.

Turning now to FIG. 5, there is shown a practical arrangement of the mode control circuit 127. The mode control circuit 127 is provided with a flip-flop circuit 147 for setting a play (PLAY) mode for automatic performance and a trigger flip-flop 148 for setting a repeat mode. The flip-flop circuits 147 and 148 light, when set, indicator lamps 149 and 150, respectively.

A start signal STRT formed by the operation of the start switch 138 is applied to a differentiating circuit 151 which produces a pulsed start signal Δ STRT. The signal Δ STRT resets the flip-flop circuit 147 through OR circuit 152, and resets the trigger flip-flop 148. The flip-flop circuit 147, when set, produces a play mode signal PLAY.

A finish signal FINISH is supplied to OR circuit 152, and AND circuit 153 which is enabled when the trigger flip-flop 148 is set. An output signal of the AND circuit 153 is applied as a preset load signal LD to a preset counter 155 of three-bit binary counter, through a delay circuit 154 consisting of a delayed flip-flop driven by the clock $\phi$.

The preset counter 155 is reset by the start signal Δ STRT and preset to "001" when the preset load signal LD is applied thereto. Three-bit outputs Ql, Q2 and Q3 of the counter 155 are coupled to a decoder 156 which sequentially produces an output signal on the output lines denoted as 0, 1, 2, 3, 4 and 5. The output signals on the output lines 0 to 4 of the decoder 156 are CLEAR (RAM 2 and RAM 3), PRE-DATA, WRITE (RAM 2) and WRITE (RAM 3), respectively. The output signals on the output lines 1, 2 and 3 of the decoder 156 are taken out from OR circuit 157 as a signal MCL which is applied as a gate signal to the gate circuit 117 supplied with the read out data from the pre-data memory 114. The decode outputs 0, 2 and 3 are coupled with NOR circuits 158, 159 and 160, as shown, to thereby form signals, MWT, MCE 2, and MCE 3. When the decode output 4 of the decoder 156 is raised, the differenting circuit 161 sets the flip-flop circuit 47. The decoder output 0 of the decoder 156, together with the signal ACTO, is coupled to the AND circuit 162 which produces the CLEAR (RAM 1) signal to reset the address counter 140.

The output signal of the AND circuit 162, the start signal Δ STRT, the signal PDEND, D1END, D2END, or FINISH is detected by an OR circuit 163. The output signal of the AND circuit 162, the signal PDEND, D1END, D2END, or FINISH is detected by an OR circuit 164. An output signal of the OR circuit 163 is taken out as the signal ADR. An output signal of the OR circuit 164 is supplied to the preset counter 155 to be counted thereby. By operation of the repeat switch 139, the repeat signal REP is supplied to a trigger terminal of the trigger flip-flop 148 to invert the output Q thereof.

The start signal Δ STRT from the mode control circuit 127 is supplied to the control register circuit 165. The M-bit parallel data from the S/P converter circuit 120 is supplied to the control register circuit 165 where it is stored. In this case, the S/P converting circuit 120 is supplied with the PDEND signal from the AND circuit 142 so that, when the count of the address counter 140 reaches M, the converting operation is stopped. Namely, the first to Mth bits of the data stored in the pre-data memory 114, or the control data, is stored in the control register circuit 165. A group of M function switches 66 respectively corresponding to M bits of the control data are provided on a panel on the electronic musical instrument. A group of display lamps for indicating states of the function switches are associated with the function switches, respectively. The lamps are selectively lit by the control data stored in the control register circuit 165. In this case, the data stored in the control register circuit 165 can be selectively rewritten by the switch group 166.

The control data stored in the control register circuit 165 is supplied to the automatic melody tone forming circuit 128, the automatic accompaniment tone forming circuit 129, and the manual musical tone forming circuit 137, thereby to determine tone color, modulation effects, etc. of musical tones.

The control data concering rhythm performance in the control register 165, or the control data for control subjects such as a rhythm type and rhythm synchro start, is supplied to a rhythm pattern memory 167. Supplied to the rhythm pattern memory 167 is a count signal from the counter 169 for counting a tempo clock signal TCL from the tempo oscillator 168. Upon receipt of the count signal, the rhythm pattern memory 167 produces a rhythm pattern signal designated by the control data. The rhythm pattern signal drives rhythm tone generators 170 thereby to form an automatic rhythm tone signal which in turn is supplied to the sound system.

The tempo clock signal from the oscillator 168 is supplied, as a clock signal adapted to measure the time duration, to the read-out control circuits 130 and 131. By an output pattern signal from the rhythm pattern memory 167, the accompaniment tone forming circuit 129 is controlled, so that the accompaniment tone signals such as chord tones and bass tones are sounded in accordance with the rhythm pattern. The mode control circuit 127 supplies the signal PLAY to the automatic melody and accompaniment tone forming circuits 128 and 129, the keyboard display circuit 136 and the read-out control circuits 130 and 131 and counter 169, thereby to instruct the automatic performance mode.

Figure 6:
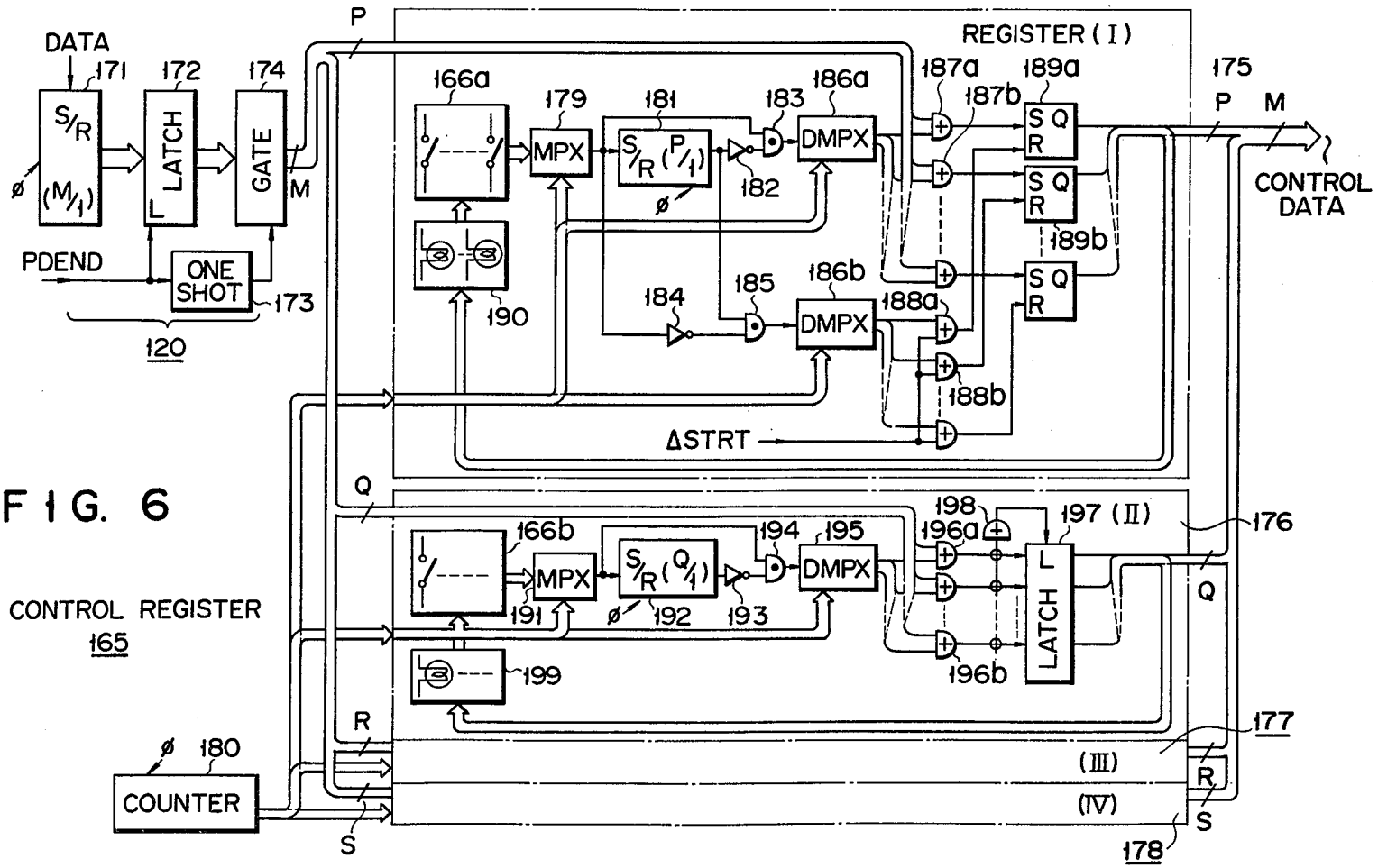
FIG. 6 is a circuit diagram of a control register shown in FIG. 1.

FIG. 6 shows a practical arrangement of the control register 165. The S/P converting circuit 120 is provided with a shift register 171 of M bits to which serial data from the pre-data memory 114 is supplied through the gate circuit 117. The M-bit parallel control data stored in the register 171 is latched into the latch circuit 172 by the signal PDEND generated when the Mth bit is read out of the memory 114. The control data latched is supplied to the control register circuit 165 through a gate circuit 174 which is enabled by an output signal of the one-shot circuit 173 driven by the signal PDEND.

The control register circuit 165 includes first to fourth registers or programmable memories 175, 176, 177 and 178. The first register 175 is adapted for control data for control subjects such as a rhythm start, tremolo and vibrato for upper and lower keyboards, and a rhythm synchro start, and has a first group of switches 166*a* comprised of ON/OFF switches corresponding to the respective bits of control data. The second register 176, the third register 177, and the fourth register 178 are respectively provided with rhythm select switches 166*b*, upper and lower keyboard tone color preset switches (not shown), and select switches (not shown) of modes such as single finger mode, a full finger mode or the like for auto accompaniment tones. In the second to fourth registers 176 to 178, a switch is provided to correspond to one bit of the control data and, when any one of switches is turned on, the remaining switches are arranged to turn off. The second to fourth registers 176 to 178 have the same construction. Accordingly, the construction of the register 176 is typically illustrated for those registers.

In the first register 175, control data of P bits set by the switch group 166*a* (P switches) adapted to be operated by a player of the musical instrument is supplied to multiplexer 179 in parallel fashion. The multiplexer 179 multiplexes the control data of P bits in time sharing manner under the control of counter 180 and supplies them to a shift register 181. An output bits of the shift register 181, together with an output bit of the multiplexer 179, is supplied to an AND circuit 183 via an inverter 182. Namely, the AND circuit 183 issues an output signal of logic 1 at a timing that when a switch of the switch group 166*a* is switched on (logic 1) an output signal of the switch obtained before switched is taken from the shift register 181. Further, the output signal of the multiplexer 179, together with an output signal of the shift register 181, is supplied to an AND circuit 185 through an inverter 184. When any one of the switches in the switch group 166*a* is turned off (logic "0") the AND circuit 185 produces an output signal of logic "1" at a timing that the output signal of the switch obtained before switched is taken from the shift register 181. The output signals of AND circuits 183 and 185 are supplied to demultiplexers 186*a* and 186*b* controlled by the counter 180, respectively, thereby to obtain parallel P bits. The P bits from demultiplexer 186*a* are supplied to P OR circuits 187*a*, 187*b*, . . . and the P bits from demultiplexer 186*b* to P OR circuits 188*a*, 188*b*, . . . .

P bits of the M-bit control data derived from the gate circuit 174 are supplied to the OR circuits 187*a*, 187*b*, . . . of which output signals are supplied to set terminals of P flip-flop circuits 189*a*, 189*b*, . . . , respectively. The start signal Δ STRT is supplied to OR circuits 188*a*, 188*b*, . . . of which output signals are supplied to reset terminals of the flip-flop circuits 189*a*, 189*b*, . . . .

When the start signal Δ STRT is generated from the mode control circuit 127, the flip-flop circuits 189*a*, 189*b*, . . . are all initially reset and thereafter are selectively set by the P-bit control data to store the control data. Under this condition, if any one of the switches of the switch group is switched from OFF to ON, the AND circuit 183 responds to the ON operation of the switch to produce a logical "1" signal to set the corresponding flip-flop. Conversely, when a switch is switched from ON to OFF, the AND circuit 185 produces, in synchronism with the OFF operation, an output signal of logic 1 which then resets the corresponding flip-flop. In other words, the memory contents of the flip-flop circuits 189*a*, 189*b*, . . . , which are dependent on the control data from the S/P converter 171, may be rewritten by the switch group 166*a* intentionally.

Reference numeral 190 designates a group of lamps provided for the respective switches of the switch group 166*a*, and are selectively lit in accordance with states of the flip-flop circuits 189*a*, 189*b*, . . . thereby to indicate a state of each bit of the control data. The switch group 166*a* is so designed that the respective switches are automatically turned ON when the corresponding lamps are lit.

In the second register 176, bit outputs corresponding to states of the switches of the switch group 166*b* are multiplexed in time sharing manner by the multiplexer 191 controlled by the counter 180 and are applied to a shift register 192 of Q bits. The output bits of the shift register 192, together with output bits from the multiplexer 191, are supplied to an AND circuit 194 by way of an inverter 193. The output bits from the AND circuit 194 are applied in parallel to OR circuits 196*a*, 196*b*, . . . by means of a demultiplexer 195. The OR circuits 196*a*, 196*b*, . . . are coupled with control data of Q bits from the S/P converting circuit 120. The output bits from the OR circuits 196*a*, 196*b*, . . . are supplied to a latch circuit 197. The latch circuit 197 latches the output bits of the OR circuits 196*a*, 106*b*, . . . in reponse to the output signal from an OR circuit 198 when a logic 1 output signal appears at the output of either of the OR circuit 196*a*, 196*b*, . . . . The bits stored in the latch circuit 197 are used as control data and also control the switch group 166*b* and the lamp group 199.

Parallel data of Q bits to selectively designate one of Q types of controls are applied from the S/P converting circuit 120 to the second register 176. For selecting a subject of control corresponding to the OR circuit 196*a*, the control data of Q bits in which only the bit supplied to the OR circuit 196*a* is "1" and the remaining bits are all "0"s, are applied and latched in the latch circuit 197. Under this condition, when one of the switches 166*b* which is in OFF state is turned ON and thus, another switch which has been in ON state is turned OFF, an output signal of logic "1" is applied from the demultiplexer 195 to the OR circuit 196*b*, for example, corresponding to the operated switch, with the result that only a stage corresponding to the OR circuit 196*b* of the latch circuit 197 stores "1". In this way, the control data applied to the auto accompaniment tone forming circuit 129 can be changed intentionally by the switch group 166*b*. The switch group 166*b* is so arranged that the switches are ON when the corresponding lamps are ON. The registers 177 and 178 are arranged like the register 176 for control data of R bits and S bits.

Figure 7:
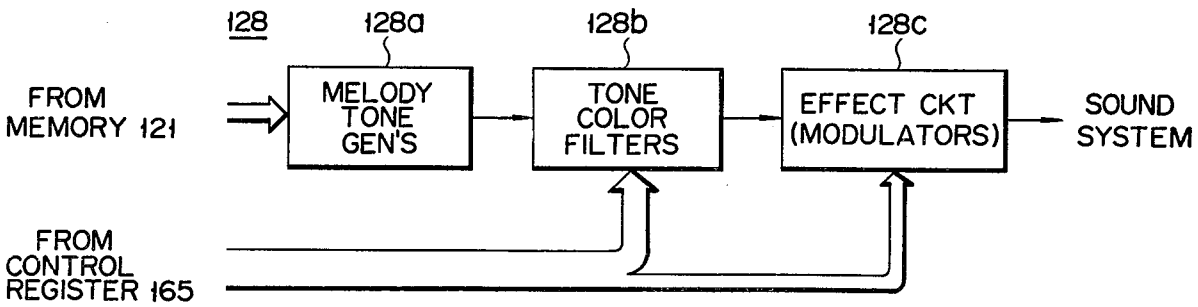
FIG. 7 shows a schematic arrangement of a musical tone generating circuit.

Referring to FIG. 7 there is shown an arrangement of the melody tone forming circuit 128 which comprises 48 tone generators 128*a*, for example, a plurality of tone coloring filters 128*b* and a plurality of musical effect imparting circuits or modulation circuits 128*c*. One of 48 tone generators 128*a* is selected by a 6-bit output signal of the memory 121 and then coupled to the tone coloring filters 128*b*. At least one of the tone coloring filters 128*b* is selected by output data from the control register 165 which specifies a tone color. The selected filter is coupled to the modulation circuits 128*c* which impart musical effects such as tremolo, chorus, ensemble, reverberation and vibrato to a tonecolored signal. At least one of the modulation circuits 128*c* is selected by musical effect designating data from the control register 165.

In the operation of the automatic performing apparatus thus constructed, when the start switch 138 is operated under a condition that the performance information has been written from the external recording medium into the pre-data memory 114, the mode control circuit 127 issues a start signal Δ STRT. The signal is supplied to the control register circuit 165, resets the flip-flop circuit 147 and the trigger flip-flop 148, and is used as a signal ADR through the OR circuit 163 to reset the address generating circuis 125 and 126 for the memories 121 and 122.

In the mode control circuit 127, the start signal Δ STRT resets the preset counter 155 so that the outputs Ql, Q2 and Q3 become "000", with the result that logic "1" signal appears on the decode output "0" of the decoder 156, that is, a clear signal CLEAR (RAM 2, RAM 3) is produced. At this time, the output signals MWT, MCE 2 and MCE 3 of NOR circuits 158 to 160 are logic "0" so that the memories 121 and 122 are both enabled to write data. When a clear signal is applied to the address generating circuits 125 and 126, the address counter 143 which has been reset by the signal ADR is counted by the clock signal $\phi$ to designate addresses in the memories 121 and 122. At this time, the gate circuit 117 connected to the output of the pre-data memory 114 is disabled. For this reason, bits of the input data to the memories 121 and 122 are all "0"s, so that the memories 121 and 122 are cleared. When the count of the address counter 143 in the address generating circuit 125 reaches the maximum value, the signal ACTO is applied to the AND circuit 162 of the mode control circuit 127. At this time, the decode output 0 of the decoder 156 is logic "1", so that output signal of the AND circuit 162 goes high, resulting in the generation of the RAM 1 clear signal and the reset of the address counter 140. Simultaneously, the output signal of the AND circuit 162 is taken out as the signal ADR through the OR circuit 63 to reset the address generating circuits 125 and 126 and to increment the count of the preset counter 155 by one through the OR circuit 164.

When the preset counter 55 is incremented by one, the decode output 1 of the decoder 156 goes high to produce a PRE-DATA signal to enable the AND circuit 142, and further to produce a signal MCL to enable the gate circuit 117.

At this time, the address counter 40 is counted by clock $\phi$ to designate addresses of the memory 114, as described. The performance information previously stored are read out bit by bit and applied through the gate circuit 117 to the S/P converting circuits 118 to 120 in parallel fashion. At this time, however, the melody data memories 121 and 122 are not in a write mode, so that the output data from the S/P converting circuits 118 and 119 are not loaded into the memories.

The control data of M bits read out of the predata memory 114 is serially loaded into the shift register 171 of the S/P converting circuit 120. When the readout operation of the control data of M bits is completed, the decoder 141 produces a detect signal to form a signal PDEND through the AND circuit 142 previously enabled by the signal PRE-DATA. As seen from FIG. 6, in the S/P converting circuit 120, the latch circuit 172 responds to the signal PDEND to latch the control data of M bits loaded into the shift register 171 and the control data bits are then applied through the gate circuit 174 to the first to fourth registers 175 to 178.

In the mode control circuit 127, the OR circuit 163 responds to the signal PDEND to produce a signal ADR to reset again the address generating circuit 125 and 126, and the OR circuit 164 advances the preset counter 155 to raise the decode output 2 of the decoder 156.

When an output signal of logic "1" appears at the output 2 of the decoder 156, the output signals of the NOR circuits 158 and 159 go to logic "0" and write signal (WRITE RAM 2) is produced. Thus, the memory 121 is enabled to write data and the address generating circuit 125 is driven by the divided clock $\phi'$. Accordingly, the first data DATA 1 read out through the gate 117 from the pre-data memory 114 following the control data is loaded through the S/P converter 118 into the melody data memory 121 every note data, as shown in FIG. 3A. After the finish code (FINISH) of the first data DATA 1 is loaded into the memory 121, the boundary code D1 is derived from the S/P converting circuit 118 and is detected by the boundary code detecting circuit 123 to produce a detect signal D1 END.

The boundary detect signal D1 END produces a signal ADR and advances the preset counter 155 to cause the decoder 156 to produce an output signal on the output 3 thereof. As a result, the signal MCE 2 goes to logic "1" and both the signals MWT (R/W) and MCE 3 go to logic "0". Therefore, the memory 121 is disabled and the memory 122 is enabled to write. The signal WRITE (RAM 3) is applied to the address generating circuit 126, so that the address generating circuit 126 is advanced by a signal obtained by dividing the clock $\phi$ by a faotor of the number of bits of the S/P converting circuit 119. Namely, the second data DATA 2 read out from the pre-data memory 114 through the gate circuit 117 is loaded into the memory 122 every code data, as shown in FIG. 3B. After the second data DATA 2 is written in the memory 120, the boundary code detecting circuit 124 produces a detect signal D2 END.

The boundary detect signal D2 END is supplied to the mode control circuit 127 which generates a signal ADR to reset the address circuits 125 and 126, and advance the preset counter 155 by one to cause the decoder 156 to produce an output signal at the output 4 thereof. Accordingly, the signal MCL goes low to disable the gate circuit 117 and the readout operation from the pre-data memory 114 terminates. Under this condition, the output signals of the NOR circuits 158 to 160 of the mode control circuit 127 are all "1"s, so that the memories 121 and 122 are set in a read mode. When the output signal at the output 4 of the decoder 156 goes high, the flip-flop circuit 147 is set by an output signal of the differentiating circuit 161. Accordingly, the play mode signal PLAY is issued and the play mode is visually indicated by the lamp 149. The signal PLAY enables the melody tone generating circuit 128 and the chord/bass tone forming circuit 129, and the readout control circuits 130, 131, and the counter 169. The data readout from the memories 121 and 122 initiates when the address generating circuits 125 and 126 are reset upon the generation of the signal ADR depending on the signal D2END.

The melody tone forming circuit 128 generates a musical tone signal corresponding to the pitch data of the note data read out from the memory 121. The accompaniment tone forming circuit 129 forms the chord and bass tone signals on the basis of the root note data read out from the memory 122. In this case, the chord and bass tone signals are gated by the rhythm pattern signal from the rhythm pattern memory 167. The output pattern signal from the rhythm pattern memory 167 drives the rhythm tone generator 170, so that the automatic rhythm performance is performend.

The control data from the control register 165 is distributed to the auto melody tone forming circuit 128 and the auto accompaniment tone forming circuit 129. The generation mode of the melody and accompaniment tones are determined by the control data. The rhythm pattern generated by the rhythm pattern memory 167 is also selected by the control data from the control register 165.

The pitch data from the memory 121 is also supplied to the keyboard display device 136 to visually indicate a key corresponding to the pitch data on the keyboard 135. Accordingly, a student or novice player can play the music on the keyboard by operating the keys indicated. On the basis of key code signals produced by the key switch circuit 135*a* through the operation of keys on the keyboard, musical tone signals are generated by the musical tone forming circuit 137. In this, way, a student can effectively practice the keyboard hearing an exemplary automatic melody performance.

In this case, if the amplitude level of musical tone signals produced by the auto melody tone forming circuit 128 is controlled, a more effective practice of the keyboard will be achieved.

During such automatic performance, the duration data contained in the note data read out of the memories 121 and 122 are stored in the readout control circuits 130 and 131. The readout control circuits 130 and 131 count the tempo clock signal TCL from the tempo oscillator 168 to measure a time duration of the duration data stored therein. After the lapse of a time corresponding to the duration data, the address counter 143 is advanced to read out the next note data from the memories 121 and 122.

The note data are successively read out from the memories 121 and 122 at time intervals corresponding to duration data contained in the note data. Finally, the finish code (FINISH) is read out of the memory 121, and detected by the finish code detecting circuit 134. The finish detect signal FINISH is supplied to the mode control circuit 127 to reset the flip-flop circuit 147 through the OR circuit 152. Simultaneously, the signal resets the address generating circuits 125 and 126 through the OR circuits 163 and 164, and increments the preset counter 155 to cause the decoder 156 to produce an output signal at the output 5 thereof. At this time, the automatic performance terminates.

During the automatic performance mode, when the repeat switch 139 is operated, the trigger flip-flop 148 being in a reset state is triggered to a set state. At this time, the repeat mode indication lamp 150 is lit and the AND circuit 153 is enabled.

When the finish detect signal FINISH is generated, under this condition, the automatic performance terminates and the AND circuit 153 produces an output signal which in turn is applied as a preset load signal LD through a delay circuit 154 to the preset counter 155 to which preset data of binary 100 (=4) has been coupled. Therefore, the preset counter 155 is preset with 100. The result is the generation of an output signal at the output 4 of the decoder 156. Accordingly, the auto play mode again initiates.

In this case, the signal FINISH is produced and the preset counter 155 is preset with a time delay of clock signal $\phi$ period behind the generation of the signal FINISH. Accordingly, the output signal ADR of the OR circuit 163 resets the address generating circuits 125 and 126. The output signal of the OR circuit 164 advances the preset counter 155 to cause the decoder 156 to produce an output signal at the output 5.

Accordingly, the preset operation raises the signal level at the output 4 of the decoder 156 to read out again the stored data in the memories 121 and 122 successively from the first address, so that the automatic performance is repeated. The repeat mode is terminated by operating the repeat switch 139 again to invert the trigger flip-flop 148 of the mode control circuit 127.

In the above-mentioned automatic performing apparatus, automatic musical tones can be produced in generating mode specified by the control data stored in the control register circuit 165. If the control data is obtained from the external recording medium the automatic performance can be carried out in a exemplary tone generating mode.

In an actual performance, it will be required that the tone generating mode such as tone color, effect, etc. be changed intentionally. In this case, however, the control data can be changed at will be operating a panel switches.

What we claim is:

1. An automatic performing apparatus of an electronic musical instrument comprising:

first readout means for reading out of an external storage means musical performance data comprising pitch data and duration data of musical notes constituting music to be automatically played and control data comprising a plurality of data units each corresponding to a specific factor which constitutes a generation mode of musical tones of said music;

first memory means for storing the musical performance data read out of said external storage means;

second memory means for storing the control data read out of said external storage means;

second readout means for reading the musical performance data out of said first memory means at time intervals represented by the duration data of musical notes in the musical performance data;

musical tone signal generating circuit means coupled to said first memory means and responsive to the pitch data in the musical performance data to produce musical tone signals, said musical tone signal generating means including means responsive to the control data from said second memory means to control the generation mode of said musical tone signals;

switch circuit means having a plurality of manual switches each corresponding to the specific generation mode constituting factor controllable by said control data; and control data modifying means coupled to said switch circuit means and said second memory means for modifying the control data stored in said second memory by selectively operating said manual switches so that the respective generation mode constituting factors are additionally and selectively controlled by said manual switches.

2. An automatic performing apparatus of an electronic musical instrument comprising:

first readout means for reading out of an external storage means musical performance data having pitch data and duration data of musical notes constituting a music to be played and control data of a plurality of bits adapted to control generation mode of musical tone signals to be generated;

first memory means for storing the musical performance data read out of said external storage means;

second memory means for storing the control data read out of said external storage means;

second readout means for reading the musical performance data out of said first memory means at time intervals represented by the duration data of musical notes in the musical performance data;

musical tone signal generating circuit means coupled to said first memory means and responsive to the pitch data in the musical performance data to produce musical tone signals, said musical tone signal generating means including means responsive to the control data from said second memory means to control the generation mode of said musical tone signals;

switch circuit means having a plurality of manual switches corresponding to said bits of said control data, respectively; and control data modifying means coupled to said switch circuit means and said second memory means for modifying the control data stored in said second memory by selectively operating said manual switches;

wherein said second memory means comprises a plurality of flip-flop circuits having their set inputs connected to receive said bits of said control data; and said control data modifying means includes a multiplexer coupled to said switch circuit means for multiplexing output signals of said manual switches in a time sharing manner; a shift register having its input coupled to said multiplexer and having stages the number of which is equal to the number of said manual switches coupled to said multiplexer; a first AND circuit having a first input directly coupled to said input of said shift register and a second input coupled to an output of said shift register through an inverter; a first demultiplexer coupled to an output of said first AND circuit for applying an output signal of said first AND circuit sequentially to said set inputs of said flip-flop circuits; a second AND circuit having a first input directly coupled to said output of said shift register and a second input coupled to said input of said shift register through an inverter; and a second demultiplexer coupled to an output of said second AND circuit for applying an output signal of said second AND circuit sequentially to reset inputs of said flip-flop circuits.

3. An automatic performing apparatus of an electronic musical instrument comprising:

first readout means for reading out of an external storage means musical performace data having pitch data and duration data of musical notes constituting a music to be played and control data of a plurality of bits adapted to control generation mode of musical tone signals to be generated;

first memory means for storing the musical performance data read out of said external storage means;

second memory means for storing the control data read out of said external storage means;

second readout means for reading the musical performance data out of said first memory means at time intervals represented by the duration data of musical notes in the musical performance data;

musical tone signal generating circuit means coupled to said first memory means and responsive to the pitch data in the musical performance data to produce musical tone signals, said musical tone signal generating means including means responsive to the control data from said second memory means to control the generation mode of said musical tone signals;

switch circuit means having a plurality of manual switches corresponding to said bits of said control data, respectively; and control data modifying means coupled to said switch circuit means and said second memory means for modifying the control data stored in said second memory by selectively operating said manual switches, wherein said second memory means includes a latch circuit having inputs connected to receive said bits of control data to latch the control data at a predetermined time; and said control data modifying means includes a multiplexer coupled to said switch circuit for multiplexing output signals of said manual switches in a timing sharing manner; a shift register having its input coupled to said multiplexer and having stages the number of which is equal to the number of said panel switches coupled to said multiplexer; an AND circuit having a first input directly coupled to said input of said shift register and a second input coupled to an output of said shift register through an inverter; and a demultiplexer coupled to an output of said AND circuit for sequentially applying an output signal of said AND circuit to said inputs of said latch circuit.

4. The automatic performing apparatus according to claim 1, wherein said second memory means includes a visual indicator circuit for visually indicating the state of each bit of said control data.

5. The automatic performing apparatus according to claim 1 further comprising keyboard means having keys; musical tone signal generating means coupled to said keyboard means for producing musical tone signals in response to depression of keys; and key indicator means coupled to said first memory means for visually indicating a key to be depressed on said keyboard means in response to the pitch data in the musical performance data read out of said first memory means.

6. An automatic performing apparatus of an electronic musical instrument comprising:

storage means for storing musical performance data comprising pitch data and duration data of musical notes constituting music to be automatically played and control data comprising a plurality of data units each corresponding to a specific factor which constitutes a generation mode of musical tones of said music;

readout means for reading out of said storage means said musical performance data and said control data;

register means for registering therein said control data read out of said storage means;

musical tone signal generating means coupled to said readout means for generating musical tone signals in accordance with said read out musical performance data and including means responsive to the control data from said register means to control the musical tone generation mode in accordance therewith;

switch circuit means having a plurality of manual switches each corresponding to the specific generation mode constituting factor controllable by said control data; and control data modifying means coupled to said switch circuit means and said register means for modifying the control data registered in said register means according to selective operations of said manual switches so that the respective generation mode constituting factors of tones being automatically played are additionally and selectively controlled by said manual switches.

7. An automatic performing apparatus of an electronic musical instrument comprising:

storage means for storing musical performance data to carry out an automatic performance of musical notes constituting music and control data comprising a plurality of data units each of which controls a specific one of tonal characteristics of said automatic music performance including a tone color, a modulation effect and an accompaniment rhythm pattern;

readout means for reading out of said storage means said musical performance data and said control data;

register means having a plurality of register locations corresponding to the respective data units of said control data, said register means storing the control data from said readout means in the register location;

musical tone signal generating means coupled to said readout means for generating musical tone signals for the automatic music performance in accordance with said read out musical performance data and including means responsive to the control data from said register means to control the tonal characteristics in accordance with the control data from said register means; switch circuit means having a plurality of manual switches corresponding to the respective data units of said control data so that each of said manual switches is assigned to a specific one of said tonal characteristics; and control data modifying means coupled to said switch circuit means and said register means for modifying the control data registered in said register means according to selective operations of said manual switches which correspond to the respective data units of the control data, thereby manually and selectively controlling the tonal characteristics of said automatic music performance in addition to the control by said control data stored in said storage means.

* * * * *